US009581150B2

(12) United States Patent
Ota et al.

(10) Patent No.: US 9,581,150 B2
(45) Date of Patent: Feb. 28, 2017

(54) VARIABLE DISPLACEMENT SWASH PLATE TYPE COMPRESSOR

(71) Applicant: KABUSHIKI KAISHA TOYOTA JIDOSHOKKI, Aichi-ken (JP)

(72) Inventors: Masaki Ota, Kariya (JP); Shinya Yamamoto, Kariya (JP); Takahiro Suzuki, Kariya (JP); Kei Nishii, Kariya (JP)

(73) Assignee: KABUSHIKI KAISHA TOSHIBA JIDOSHOKKI, Aichi-Ken ( * ) Notice: Subject to any disclaimer, the term of this patent is extended or adjusted under 35 U.S.C. 154(b) by 315 days.

(21) Appl. No.: 14/447,930

(22) Filed: Jul. 31, 2014

(65) Prior Publication Data

US 2015/0044067 A1 Feb. 12, 2015

(30) Foreign Application Priority Data

Aug. 8, 2013 (JP) ..... 2013-165558

(51) Int. Cl.
*F04B 27/18* (2006.01)
*F04B 1/20* (2006.01)
(Continued)

(52) U.S. Cl.
CPC ..... *F04B 27/1804* (2013.01); *F04B 1/2078* (2013.01); *F04B 1/295* (2013.01);
(Continued)

(58) Field of Classification Search
CPC ..... F04B 2205/15; F04B 49/22; F04B 49/24; F04B 53/10; F04B 1/295; F04B 2027/1813; F04B 2027/1831; F04B 2027/1854; F04B 27/12; F04B 27/18; F04B 27/1804; F04B 27/1054; F04B 2027/1809; F04B 2027/185; F04C 14/24; F04C 2270/58; F04C 28/24; F04D 15/0005; F04D 15/02; F04D 27/009; F04D 27/0207
USPC ..... 417/222.1, 222.2, 269, 270; 62/498
See application file for complete search history.

(56) References Cited

U.S. PATENT DOCUMENTS 4,932,843 A 6/1990 Itoigawa et al.
6,227,812 B1 * 5/2001 Kawaguchi ..... F04B 27/1804 417/222.2
(Continued)

FOREIGN PATENT DOCUMENTS

EP 1 033 489 9/2000
JP 01-190972 8/1989
(Continued)

OTHER PUBLICATIONS

U.S. Appl. No. 14/507,102 to Masaki Ota et al., filed Oct. 6, 2014.
(Continued)

*Primary Examiner* — Dominick L Plakkoottam
(74) *Attorney, Agent, or Firm* — Greenblum & Bernstein, P.L.C.

(57) ABSTRACT

A variable displacement swash plate type compressor includes a displacement control valve. The displacement control valve includes a drive force transmitting member, a valve member having a first valve body, a pressure sensing mechanism, which adjusts the valve opening degree of the first valve body, a communication passage, which connects a back pressure chamber and an accommodating chamber to each other, and a second valve body, which selectively opens and closes the communication passage. The first valve body opens when current supply to an electromagnetic solenoid is stopped and the pressure in a suction pressure zone is less than a threshold value. The second valve body closes when current is supplied to the electromagnetic solenoid and
(Continued)

opens when the current supply to the electromagnetic solenoid is stopped and the pressure in the suction pressure zone is greater than or equal to the threshold value.

11 Claims, 10 Drawing Sheets

(51) Int. Cl.
*F04B 1/29* (2006.01)
*F04B 27/12* (2006.01)

(52) U.S. Cl.
CPC ..... *F04B 27/12* (2013.01); *F04B 2027/185* (2013.01); *F04B 2027/1809* (2013.01); *F04B 2027/1813* (2013.01); *F04B 2027/1831* (2013.01)

(56) References Cited

U.S. PATENT DOCUMENTS 6,382,926 B2 * 5/2002 Ota ..... F04B 27/1804 417/222.2
8,152,482 B2 4/2012 Umemura et al.
9,010,138 B2 * 4/2015 Yoshida ..... F04B 11/0091 417/213
9,228,576 B2 * 1/2016 Yamamoto ..... F04B 27/18
9,316,217 B2 * 4/2016 Yamamoto ..... F04B 27/1804
2005/0287014 A1 * 12/2005 Umemura ..... F04B 27/1804 417/222.1
2009/0220356 A1 * 9/2009 Yamamoto ..... F04B 27/1804 417/222.1
2009/0269216 A1 * 10/2009 Ota ..... F04B 27/1804 417/222.1
2012/0251343 A1 * 10/2012 Taguchi ..... F04B 27/1804 417/222.2
2013/0126017 A1 * 5/2013 Ota ..... F04B 27/1804 137/487.5

FOREIGN PATENT DOCUMENTS

JP 7-027049 1/1995
JP 2011-149377 8/2011

OTHER PUBLICATIONS

U.S. Appl. No. 14/447,940 to Masaki Ota et al., filed Jul. 31, 2014.

* cited by examiner

VARIABLE DISPLACEMENT SWASH PLATE TYPE COMPRESSOR

BACKGROUND OF THE INVENTION

The present invention relates to a variable displacement swash plate type compressor, in which pistons engaged with a swash plate are reciprocated by a stroke corresponding to the inclination angle of a swash plate.

Such a compressor is disclosed in Japanese Laid-Open Patent Publication No. 1-190972. The compressor has a housing that accommodates a swash plate and a movable body, which is coupled to the swash plate to alter the inclination angle of the swash plate. A control pressure chamber is formed in the housing. As control gas is introduced to the control pressure chamber, the pressure inside the control pressure chamber is changed. This moves the movable body along the axis of the rotary shaft. As the movable body is moved along the axis of the rotary shaft, the inclination angle of the swash plate is changed.

Specifically, when the pressure in the control pressure chamber is increased, the movable body is moved toward a first end in the axial direction of the rotary shaft. The movement of the movable body increases the inclination angle of the swash plate. When the pressure in the control pressure chamber is lowered, the movable body is moved toward a second end in the axial direction of the rotary shaft. The movement of the movable body decreases the inclination angle of the swash plate. As the inclination angle of the swash plate is reduced, the stroke of the pistons is reduced. Accordingly, the displacement is decreased. In contrast, as the inclination angle of the swash plate is increased, the stroke of the pistons is increased. Accordingly, the displacement is increased. The variable displacement swash plate type compressor has a displacement control valve, which controls the pressure in the control pressure chamber.

In such a variable displacement swash plate type compressor, when the switch of the vehicle air conditioner is turned off and the current supply to the electromagnetic solenoid of the displacement control valve is stopped, changes in the pressure in the suction pressure zone may maintain the inclination angle of the swash plate at an angle greater than the minimum inclination angle. When the air conditioner switch is turned on again and the current supply to the electromagnetic solenoid is resumed, the displacement is abruptly increased. This increases the load on the variable displacement swash plate type compressor. Therefore, the inclination angle of the swash plate is preferably minimized when the air conditioner switch is turned off and the current supply to the electromagnetic solenoid is stopped.

SUMMARY OF THE INVENTION

Accordingly, it is an objective of the present invention to provide a variable displacement swash plate type compressor that is capable of minimizing the inclination angle of a swash plate when a current supply to the electromagnetic solenoid is stopped and maintaining the minimum inclination angle.

To achieve the foregoing objective and in accordance with one aspect of the present invention, a variable displacement swash plate type compressor is provided that includes a housing having a crank chamber, a swash plate accommodated in the crank chamber, a piston engaged with the swash plate, a movable body, which is coupled to the swash plate and changes the inclination angle of the swash plate, a control pressure chamber defined in the housing by the movable body, and a displacement control valve that controls the pressure in the control pressure chamber. The swash plate receives a drive force from a rotary shaft to rotate and is capable of changing its inclination angle relative to the rotary shaft. Pressure in the control pressure chamber is changed by introducing control gas therein so that the movable body is moved in the axial direction of the rotary shaft. The piston is reciprocated by a stroke that corresponds to the inclination angle of the swash plate. The displacement control valve includes a drive force transmitting member, which is driven by an electromagnetic solenoid, a valve member having a first valve body, a valve chamber, which accommodates the first valve body and communicates with the suction pressure zone, a back pressure chamber, which is located between the electromagnetic solenoid and the valve chamber and is connected to the valve chamber, an accommodating chamber, which communicates with the control pressure chamber, a pressure sensing mechanism, which is accommodated in the accommodating chamber and integrated with the valve member, a communication passage, which is formed in the valve member and connects the back pressure chamber and the accommodating chamber to each other, and a second valve body, which is located between the drive force transmitting member and the valve member and selectively opens and closes the communication passage. The first valve body adjusts an opening degree of discharge passage that extends from the control pressure chamber to a suction pressure zone. By sensing, in at least one of the back pressure chamber and the valve chamber, a pressure in the suction pressure zone that acts on the valve member, the pressure sensing mechanism extends or contracts in the moving direction of the drive force transmitting member, thereby adjusting the valve opening degree of the first valve body. The first valve body is in an open state when a current supply to the electromagnetic solenoid is stopped and the pressure in the suction pressure zone is less than a threshold value. The second valve body closes when a current is supplied to the electromagnetic solenoid and opens when the current supply to the electromagnetic solenoid is stopped and the pressure in the suction pressure zone is greater than or equal to the threshold value.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A variable displacement swash plate type compressor according to one embodiment will now be described with reference to FIGS. 1 to 7. The variable displacement swash plate type compressor is adapted to be used in a vehicle air conditioner.

Figure 1:
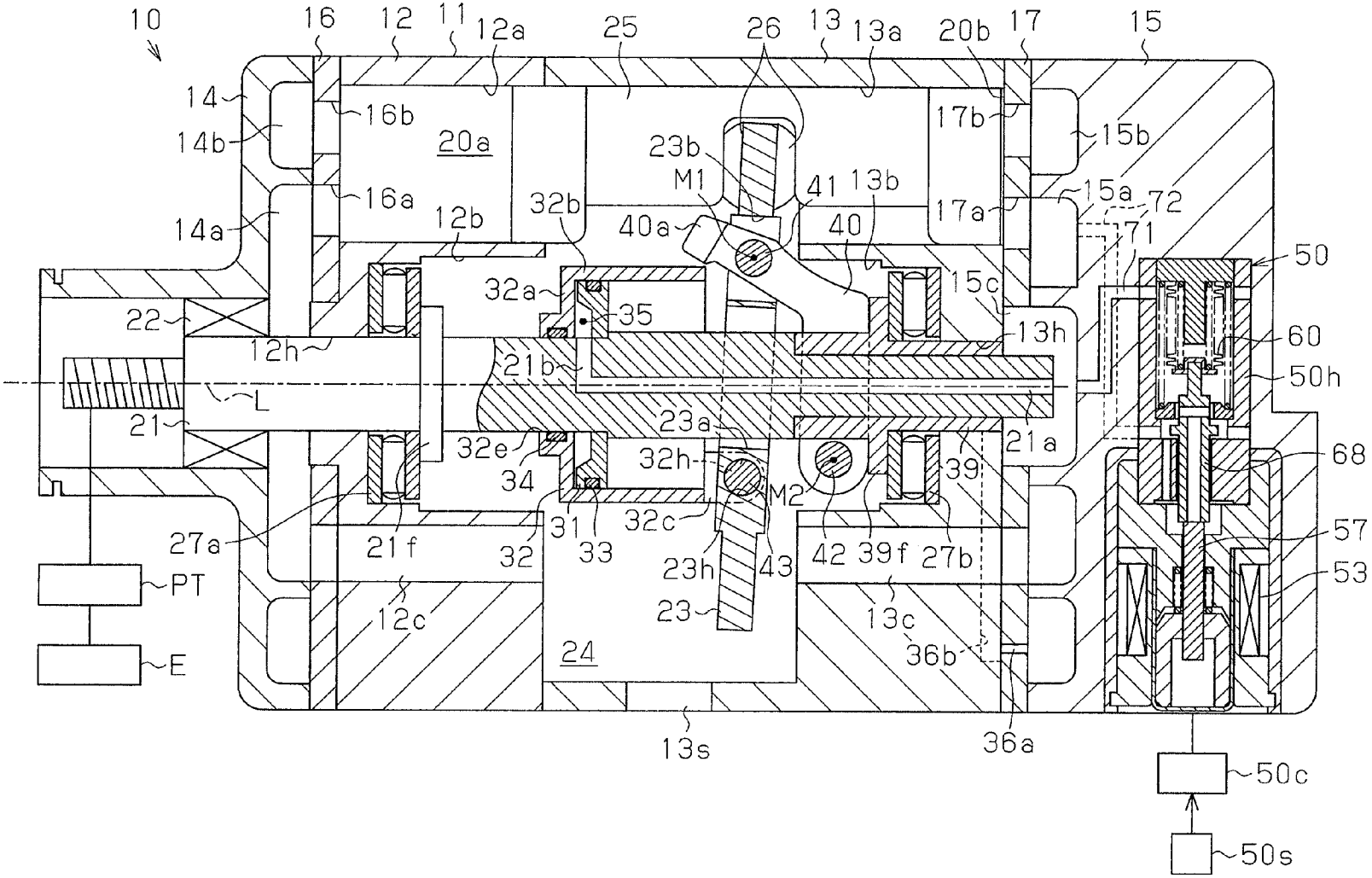
FIG. 1 is a cross-sectional side view illustrating a variable displacement swash plate type compressor according to one embodiment.

As shown in FIG. 1, the variable displacement swash plate type compressor 10 includes a housing 11, which is formed by a first cylinder block 12 located on the front side (first side) and a second cylinder block 13 located on the rear side (second side). The first and second cylinder blocks 12, 13 are joined to each other. The housing 11 further includes a front housing member 14 joined to the first cylinder block 12 and a rear housing member 15 joined to the second cylinder block 13.

A first valve plate 16 is arranged between the front housing member 14 and the first cylinder block 12. Further, a second valve plate 17 is arranged between the rear housing member 15 and the second cylinder block 13.

A suction chamber 14*a* and a discharge chamber 14*b* are defined between the front housing member 14 and the first valve plate 16. The discharge chamber 14*b* is located radially outward of the suction chamber 14*a*. Likewise, a suction chamber 15*a* and a discharge chamber 15*b* are defined between the rear housing member 15 and the second valve plate 17. Additionally, a pressure adjusting chamber 15*c* is formed in the rear housing member 15. The pressure adjusting chamber 15*c* is located at the center of the rear housing member 15, and the suction chamber 15*a* is located radially outward of the pressure adjusting chamber 15*c*. The discharge chamber 15*b* is located radially outward of the suction chamber 15*a*. The discharge chamber 14*b*, 15*b* are connected to each other through a discharge passage (not shown). The discharge passage is in turn connected to an external refrigerant circuit (not shown). The discharge chambers 14*b*, 15*b* are discharge pressure zones.

The first valve plate 16 has suction ports 16*a* connected to the suction chamber 14*a* and discharge ports 16*b* connected to the discharge chamber 14*b*. The second valve plate 17 has suction ports 17*a* connected to the suction chamber 15*a* and discharge ports 17*b* connected to the discharge chamber 15*b*. A suction valve mechanism (not shown) is arranged in each of the suction ports 16*a*, 17*a*. A discharge valve mechanism (not shown) is arranged in each of the discharge ports 16*b*, 17*b*.

A rotary shaft 21 is rotationally supported in the housing 11. A part of the rotary shaft 21 on the front side (first side) extends through a shaft hole 12*h*, which is formed to extend through the first cylinder block 12. Specifically, the front part of the rotary shaft 21 refers to a part of the rotary shaft 21 that is located on the first side in the direction along the axis L of the rotary shaft 21 (the axial direction of the rotary shaft 21). The front end of the rotary shaft 21 is located in the front housing member 14. A part of the rotary shaft 21 on the rear side (second side) extends through a shaft hole 13*h*, which is formed in the second cylinder block 13. Specifically, the rear part of the rotary shaft 21 refers to a part of the rotary shaft 21 that is located on the second side in the direction in which the axis L of the rotary shaft 21 extends. The rear end of the rotary shaft 21 is located in the pressure adjusting chamber 15*c*.

The front part of the rotary shaft 21 is rotationally supported by the first cylinder block 12 at the shaft hole 12*h*. The rear part of the rotary shaft 21 is rotationally supported by the second cylinder block 13 at the shaft hole 13*h*. A sealing device 22 of lip seal type is located between the front housing member 14 and the rotary shaft 21. The front end of the rotary shaft 21 is connected to and driven by an external drive source, which is a vehicle engine E in this embodiment, through a power transmission mechanism PT. In the present embodiment, the power transmission mechanism PT is a clutchless mechanism (for example, a combination of a belt and pulleys), which constantly transmits power.

In the housing 11, the first cylinder block 12 and the second cylinder block 13 define a crank chamber 24. A swash plate 23 is accommodated in the crank chamber 24. The swash plate 23 receives drive force from the rotary shaft 21 to be rotated. The swash plate 23 also tilts along the axis L of the rotary shaft 21 with respect to the rotary shaft 21. The swash plate 23 has an insertion hole 23*a*, through which the rotary shaft 21 can extends. The swash plate 23 is assembled to the rotary shaft 21 by inserting the rotary shaft 21 into the insertion hole 23*a*.

The first cylinder block 12 has first cylinder bores 12*a* (only one of the first cylinder bores 12*a* is illustrated in FIG. 1), which extend along the axis of the first cylinder block 12 and are arranged about the rotary shaft 21. Each first cylinder bore 12*a* is connected to the suction chamber 14*a* via the corresponding suction port 16*a* and is connected to the discharge chamber 14*b* via the corresponding discharge port 16*b*. The second cylinder block 13 has second cylinder bores 13*a* (only one of the second cylinder bores 13*a* is illustrated in FIG. 1), which extend along the axis of the second cylinder block 13 and are arranged about the rotary shaft 21. Each second cylinder bore 13*a* is connected to the suction chamber 15*a* via the corresponding suction port 17*a* and is connected to the discharge chamber 15*b* via the corresponding discharge port 17*b*. The first cylinder bores 12*a* and the second cylinder bores 13*a* are arranged to make front-rear pairs. Each pair of the first cylinder bore 12*a* and the second cylinder bore 13*a* accommodates a double-headed piston 25, while permitting the piston 25 to reciprocate in the front-rear direction. That is, the variable displacement swash plate type compressor 10 of the present embodiment is a double-headed piston swash plate type compressor.

Each double-headed piston 25 is engaged with the periphery of the swash plate 23 with two shoes 26. The shoes 26 convert rotation of the swash plate 23, which rotates with the rotary shaft 21, to linear reciprocation of the double-headed pistons 25. In each first cylinder bore 12*a*, a first compression chamber 20*a* is defined by the double-headed piston 25 and the first valve plate 16. In each second cylinder bore 13*a*, a second compression chamber 20*b* is defined by the double-headed piston 25 and the second valve plate 17.

The first cylinder block 12 has a first large diameter hole 12*b*, which is continuous with the shaft hole 12*h* and has a larger diameter than the shaft hole 12*h*. The first large diameter hole 12*b* communicates with the crank chamber 24. The crank chamber 24 and the suction chamber 14*a* are connected to each other by a suction passage 12*c*, which extends through the first cylinder block 12 and the first valve plate 16.

The second cylinder block 13 has a second large diameter hole 13*b*, which is continuous with the shaft hole 13*h* and has a larger diameter than the shaft hole 13*h*. The second large diameter hole 13*b* communicates with the crank chamber 24. The crank chamber 24 and the suction chamber 15*a* are connected to each other by a suction passage 13*c*, which extends through the second cylinder block 13 and the second valve plate 17.

A suction inlet 13*s* is formed in the peripheral wall of the second cylinder block 13. The suction inlet 13*s* is connected to the external refrigerant circuit. Refrigerant gas is drawn into the crank chamber 24 from the external refrigerant circuit via the suction inlet 13*s* and is then drawn into the suction chambers 14*a*, 15*a* via the suction passages 12*c*, 13*c*. The suction chambers 14*a*, 15*a* and the crank chamber 24 are therefore in a suction pressure zone. The pressure in the suction chambers 14*a*, 15*a* and the pressure in the crank chamber 24 are substantially equal to each other.

The rotary shaft 21 has an annular flange portion 21*f*, which extends in the radial direction. The flange portion 21*f* is arranged in the first large diameter hole 12*b*. With respect to the axial direction of the rotary shaft 21, a first thrust bearing 27*a* is arranged between the flange portion 21*f* and the first cylinder block 12. A cylindrical supporting member 39 is press fitted to a rear portion of the rotary shaft 21. The supporting member 39 has an annular flange portion 39*f*, which extends in the radial direction. The flange portion 39*f* is arranged in the second large diameter hole 13*b*. With respect to the axial direction of the rotary shaft 21, a second thrust bearing 27*b* is arranged between the flange portion 39*f* and the second cylinder block 13.

An annular fixed body 31 is fixed to the rotary shaft 21 to be integrally rotational with the rotary shaft 21. The fixed body 31 is located rearward of the flange portion 21*f* and forward of the swash plate 23. A cylindrical movable body 32 having a closed end is located between the flange portion 21*f* and the fixed body 31. The movable body 32 is movable along the axis of the rotary shaft 21 with respect to the fixed body 31.

The movable body 32 is formed by an annular bottom portion 32*a* and a cylindrical portion 32*b*. An insertion hole 32*e* is formed in the bottom portion 32*a* to receive the rotary shaft 21. The cylindrical portion 32*b* extends along the axis of the rotary shaft 21 from the peripheral edge of the bottom portion 32*a*. The inner circumferential surface of the cylindrical portion 32*b* is slidable along the outer circumferential surface of the fixed body 31. This allows the movable body 32 to rotate integrally with the rotary shaft 21 via the fixed body 31. The clearance between the inner circumferential surface of the cylindrical portion 32*b* and the outer circumferential surface of the fixed body 31 is sealed by a sealing member 33. The clearance between the insertion hole 32*e* and the rotary shaft 21 is sealed by a sealing member 34. The fixed body 31 and the movable body 32 define a control pressure chamber 35 in between.

A first in-shaft passage 21*a* is formed in the rotary shaft 21. The first in-shaft passage 21*a* extends along the axis L of the rotary shaft 21. The rear end of the first in-shaft passage 21*a* is opened to the interior of the pressure adjusting chamber 15*c*. A second in-shaft passage 21*b* is formed in the rotary shaft 21. The second in-shaft passage 21*b* extends in the radial direction of the rotary shaft 21. One end of the second in-shaft passage 21*b* communicates with the first in-shaft passage 21*a*. The other end of the second in-shaft passage 21*b* is opened to the interior of the control pressure chamber 35. Accordingly, the control pressure chamber 35 and the pressure adjusting chamber 15*c* are connected to each other by the first in-shaft passage 21*a* and the second in-shaft passage 21*b*.

In the crank chamber 24, a lug arm 40 is provided between the swash plate 23 and the flange portion 39*f*. The lug arm 40 substantially has an L shape extending from a first end to a second end. The lug arm 40 has a weight portion 40*a* formed at one end. The weight portion 40*a* extends to a position in front of the swash plate 23 through a groove 23*b* of the swash plate 23.

The first end of the lug arm 40 is coupled to the upper side (upper side as viewed in FIG. 1) of the swash plate 23 by a first pin 41, which extends across the groove 23*b*. This structure allows the first end of the lug arm 40 to be supported by the swash plate 23 such that the first end of the lug arm 40 can pivot about a first pivot axis M1, which coincides with the axis of the first pin 41. The second end of the lug arm 40 is coupled to the supporting member 39 by a second pin 42. This structure allows the second end of the lug arm 40 to be supported by the supporting member 39 such that the second end of the lug arm 40 can pivot about a second pivot axis M2, which coincides with the axis of the second pin 42.

A coupling portion 32*c* is formed at the distal end of the cylindrical portion 32*b* of the movable body 32. The coupling portion 32*c* protrudes toward the swash plate 23. The coupling portion 32*c* has a movable body insertion hole 32*h* for receiving a third pin 43. The swash plate 23 has a swash plate insertion hole 23*h* for receiving the third pin 43 on the lower side (lower side as viewed in FIG. 1). The third pin 43 couples the coupling portion 32*c* to the lower part of the swash plate 23.

The second valve plate 17 has a restriction 36*a*, which communicates with the discharge chamber 15*b*. The second cylinder block 13 has a communication portion 36*b* in an end face that faces the second valve plate 17. The communication portion 36*b* connects the pressure adjusting chamber 15*c* and the restriction 36*a* to each other. The discharge chamber 15*b* and the control pressure chamber 35 are connected to each other via the restriction 36*a*, the communication portion 36*b*, the pressure adjusting chamber 15*c*, the first in-shaft passage 21*a*, and the second in-shaft passage 21*b*. Therefore, the restriction 36*a*, the communication portion 36*b*, the pressure adjusting chamber 15*c*, the first in-shaft passage 21*a*, and the second in-shaft passage 21*b* form a supply passage extending from the discharge chamber 15*b* to the control pressure chamber 35. The restriction 36*a* reduces the opening degree of the supply passage.

An electromagnetic displacement control valve 50 for controlling the pressure in the control pressure chamber 35 is installed in the rear housing member 15. The displacement control valve 50 is electrically connected to a control computer 50*c*. Signaling connection is provided between the control computer 50*c* and an air conditioner switch 50*s*.

Figure 2:
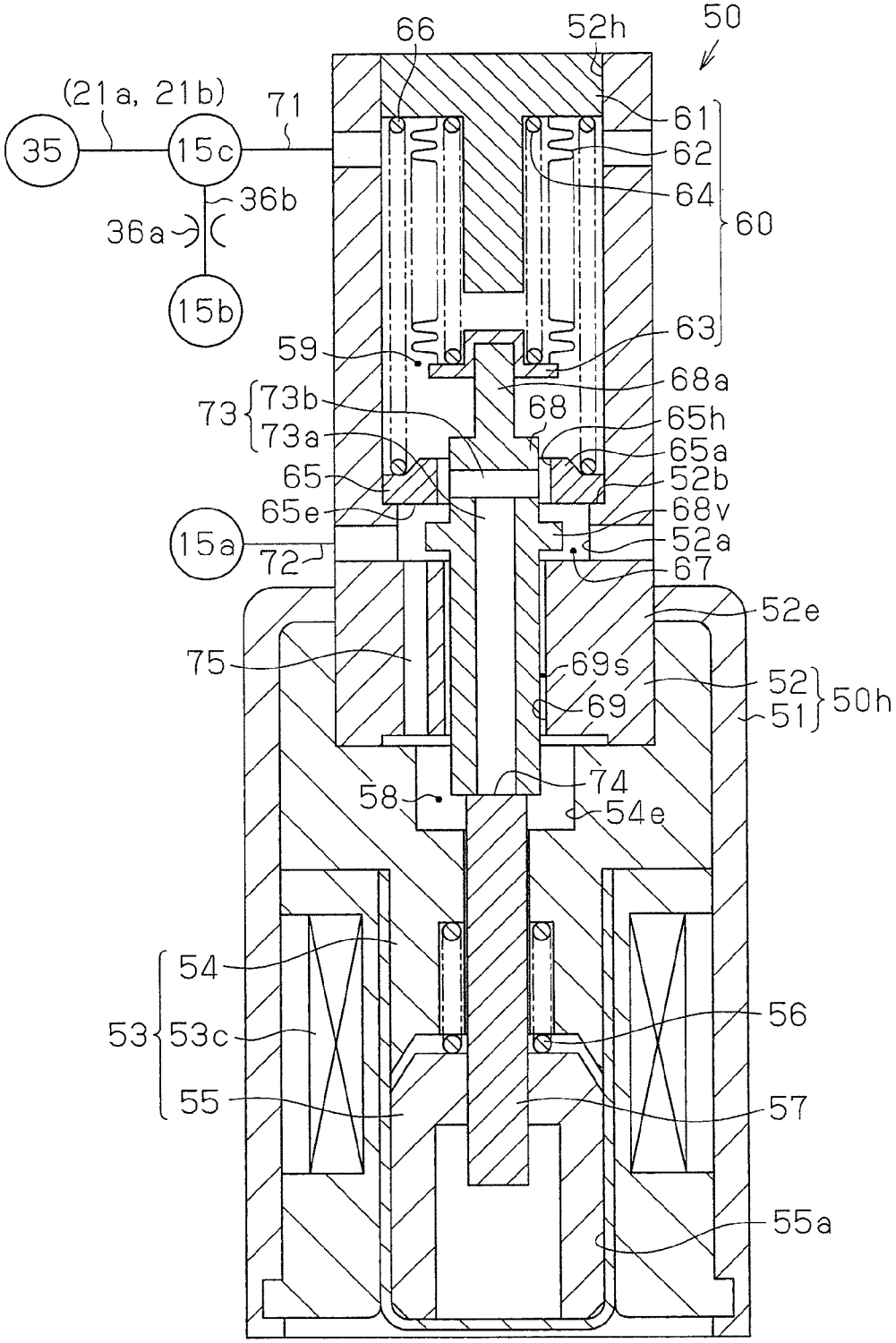
FIG. 2 is a cross-sectional view of a displacement control valve when the swash plate is at the minimum inclination angle.

As shown in FIG. 2, a valve housing 50*h* of the displacement control valve 50 is formed by a cylindrical first housing member 51, which accommodates an electromagnetic solenoid 53, and a cylindrical second housing member 52, which has a closed end and attached to the first housing member 51.

The electromagnetic solenoid 53 has a fixed iron core 54 and a movable iron core 55, which is attracted to the fixed iron core 54 based on excitation by current supplied to a coil 53*c*. The fixed iron core 54 is arranged to be closer to the second housing member 52 than the movable iron core 55 is to the second housing member 52. The electromagnetic force of the electromagnetic solenoid 53 attracts the movable iron core 55 toward the fixed iron core 54. The electromagnetic solenoid 53 is subjected to current control (duty cycle control) performed by the control computer 50*c*. A spring 56 is located between the fixed iron core 54 and the movable iron core 55. The spring 56 urges the movable iron core 55 away from the fixed iron core 54.

A pillar-like drive force transmitting member 57 is attached to the movable iron core 55. The drive force transmitting member 57 is allowed to move integrally with the movable iron core 55. A back pressure chamber 58 is defined between a bottom wall 52*e* of the second housing member 52 and the fixed iron core 54. The drive force transmitting member 57 extends through the fixed iron core 54 and projects into the back pressure chamber 58. The fixed iron core 54 has a recess 54*e*, which is formed in an end face of the fixed iron core 54 that is close to the bottom wall 52*e* of the second housing member 52 and surrounds the drive force transmitting member 57. The recess 54*e* and the bottom wall 52*e* define the back pressure chamber 58.

An accommodating chamber 59 is formed in the second housing member 52. The accommodating chamber 59 accommodates a pressure sensing mechanism 60. The pressure sensing mechanism 60 is formed by a pressure receiving body 61, a bellows 62, which can extend and contract, a coupling body 63, and spring 64. The pressure receiving body 61 is press fitted in an insertion hole 52*h*, which is located on the opposite side of the second housing member 52 to the first housing member 51. The bellows 62 has an end coupled to the pressure receiving body 61. The coupling body 63 is coupled to the other end of the bellows 62. The spring 64 urges the pressure receiving body 61 and the coupling body 63 away from each other in the bellows 62.

A recess 52*a*, which is continuous with the accommodating chamber 59, is formed in the bottom wall 52*e* of the second housing member 52. Further, an annular valve seat member 65, which has a valve hole 65*h*, is arranged in the accommodating chamber 59 at a position close to the bottom wall 52*e*. The valve seat member 65 is formed separately from the second housing member 52. The end face of the valve seat member 65 that faces the recess 52*a* is flat and contacts a step 52*b* formed between the accommodating chamber 59 and the recess 52*a* with each other. The valve seat member 65 has an annular projection 65*a* formed on the inner end face, which faces the pressure sensing mechanism 60. The projection 65*a* projects toward the pressure sensing mechanism 60.

An urging spring 66 is located between the valve seat member 65 and the pressure receiving body 61. The end of the urging spring 66 that faces the pressure receiving body 61 is coupled to the pressure receiving body 61, and the end of the urging spring 66 that faces the valve seat member 65 is coupled to a part of the valve seat member 65 that is outside the projection 65*a*. Since the projection 65*a* is located in the urging spring 66, the urging spring 66 is prevented from moving toward the projection 65*a* by the projection 65*a*. The valve seat member 65 is pressed against the step 52*b* by the urging spring 66 so that the position of the valve seat member 65 is determined.

A valve chamber 67 is defined between the valve seat member 65 and the recess 52*a* in the second housing member 52. The second housing member 52 accommodates a valve member 68, which extends through the bottom wall 52*e* of the second housing member 52. The valve member 68 also extends through the valve chamber 67 and the valve hole 65*h* from the back pressure chamber 58 to the accommodating chamber 59. The valve member 68 has a first valve body 68*v*, which is accommodated in the valve chamber 67. The outer diameter of the first valve body 68*v* is greater than the diameter of the shaft of the valve member 68. The valve member 68 is formed of a material that is lighter than that of the drive force transmitting member 57, for example, of aluminum. The surface of the valve member 68 is subjected to surface treatment, for example, coating of a high abrasion resistance.

The valve member 68 has a pillar-like projection 68*a* on an end face that is located in the accommodating chamber 59. The projection 68*a* is coupled to the coupling body 63. That is, the valve member 68 is integrated with the pressure sensing mechanism 60.

On the end face of the valve seat member 65 that faces the recess 52*a*, a valve seat 65*e*, on which the first valve body 68*v* is seated, is formed about the valve hole 65*h*. Therefore, the valve seat member 65 has the valve seat 65*e*, on which the first valve body 68*v* is seated. The first valve body 68*v* is capable of opening and closing the valve hole 65*h* by separating from and contacting the valve seat 65*e*. A cylindrical guide wall 69 is formed in the bottom wall 52*e* of the second housing member 52. The guide wall 69 guides the valve member 68 in the moving direction of the drive force transmitting member 57. The back pressure chamber 58 is located between the electromagnetic solenoid 53 and the valve chamber 67. The valve chamber 67 and the back pressure chamber 58 are connected to each other via a clearance 69*s* between the guide wall 69 and the valve member 68. A communication passage 75, which connects the valve chamber 67 and the back pressure chamber 58 to each other, is formed in the bottom wall 52*e* of the second housing member 52. The back pressure chamber 58 is connected to an accommodating chamber 55*a*, which accommodates the movable iron core 55, via a clearance between the drive force transmitting member 57 and the fixed iron core 54.

The accommodating chamber 59 communicates with the pressure adjusting chamber 15*c* through a passage 71. The valve chamber 67 communicates with the suction chamber 15*a* through a passage 72. Accordingly, the second in-shaft passage 21*b*, the first in-shaft passage 21*a*, the pressure adjusting chamber 15*c*, the passage 71, the accommodating chamber 59, the valve hole 65*h*, the valve chamber 67, and the passage 72 form a discharge passage extending from the control pressure chamber 35 to the suction chamber 15*a*.

The cross-sectional area of the valve hole 65*h*, which is selectively opened and closed by the first valve body 68*v*, is equal to the effective pressure receiving area of the bellows 62. Therefore, when the first valve body 68*v* is closed, the pressure sensing mechanism 60 is not influenced by the pressure in the accommodating chamber 59. The bellows 62 senses the pressure that is applied to the valve member 68 in the back pressure chamber 58, thereby either extending or contracting in the moving direction of the drive force transmitting member 57. Extension and contraction of the bellows 62 is used to position the first valve body 68*v* and contributes to the adjustment of the valve opening degree of the first valve body 68*v*. The opening degree of the first valve body 68*v* is determined by the balance of the electromagnetic force produced by the electromagnetic solenoid 53, the force of the spring 56, and the urging force of the pressure sensing mechanism 60.

The first valve body 68*v* adjusts the opening degree (passage cross-sectional area) of the discharge passage. When the first valve body 68*v* is seated on the valve seat 65*e*, the discharge passage is closed. In contrast, when the first valve body 68*v* separates from the valve seat 65*e*, the discharge passage is open.

Refrigerant gas is introduced to the control pressure chamber 35 from the discharge chamber 15*b* via the restriction 36*a*, the communication portion 36*b*, the pressure adjusting chamber 15*c*, the first in-shaft passage 21*a*, and the second in-shaft passage 21*b*. Also, refrigerant gas is discharged from the control pressure chamber 35 to the suction chamber 15*a* via the second in-shaft passage 21*b*, the first in-shaft passage 21*a*, the pressure adjusting chamber 15*c*, the passage 71, the accommodating chamber 59, the valve hole 65*h*, the valve chamber 67, and the passage 72. As a result, the pressure in the control pressure chamber 35 is adjusted. Thus, the refrigerant gas introduced into the control pressure chamber 35 serves as control gas for regulating the pressure in the control pressure chamber 35. The pressure difference between the control pressure chamber 35 and the crank chamber 24 causes the movable body 32 to move along the axis of the rotary shaft 21 with respect to the fixed body 31.

The valve member 68 has a communication passage 73, which connects the back pressure chamber 58 and the accommodating chamber 59 with each other. The communication passage 73 is formed by a first passage 73*a* and a second passage 73*b*. The first passage 73*a* extends along the axis of the valve member 68 and has an end that opens in the back pressure chamber 58. The second passage 73*b* communicates with the other end of the first passage 73*a*. Also, the second passage 73*b* extends in a direction perpendicular to the first passage 73*a* and opens in the accommodating chamber 59.

An end of the drive force transmitting member 57 that faces the valve member 68 functions as a second valve body 74, which selectively opens and closes the communication passage 73 by separating from and contacting an end of the valve member 68 that faces the drive force transmitting member 57. Thus, the second valve body 74 is located between the drive force transmitting member 57 and the valve member 68 and integrated with the drive force transmitting member 57 in the present embodiment. That is, the drive force transmitting member 57 includes the second valve body 74.

When the air conditioner switch 50*s* is turned on, current is supplied to the electromagnetic solenoid 53. At this time, the second valve body 74 closes the communication passage 73. When the air conditioner switch 50*s* is turned off, the current supply to the electromagnetic solenoid 53 is stopped. At this time, the second valve body 74 opens the communication passage 73.

Figure 3:
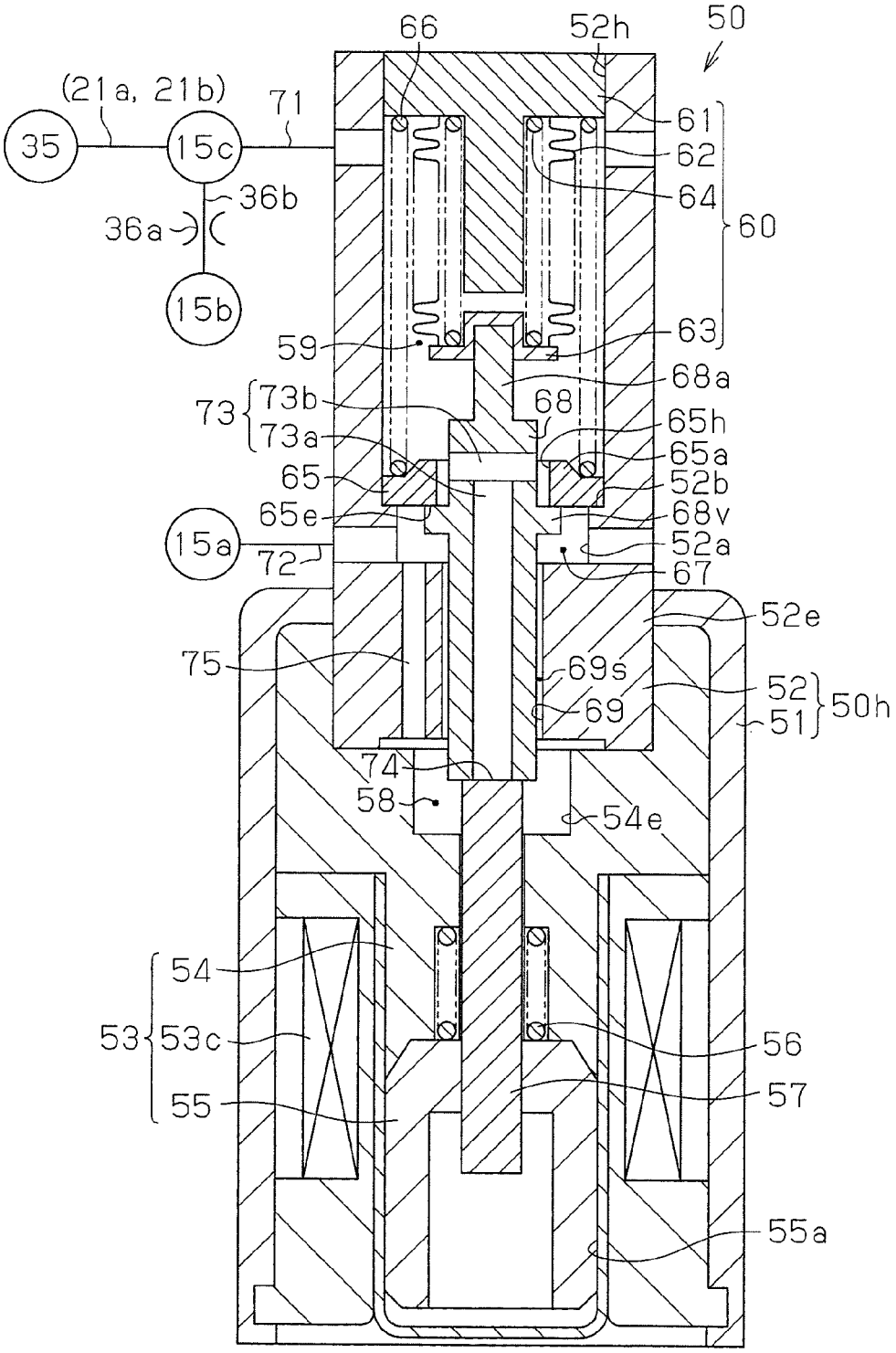
FIG. 3 is a cross-sectional view of a displacement control valve when the swash plate is at the maximum inclination angle.

When the air conditioner switch 50*s* is turned on, current is supplied to the electromagnetic solenoid 53 of the variable displacement swash plate type compressor 10, which has the above described configuration. At this time, the electromagnetic force of the electromagnetic solenoid 53 attracts the movable iron core 55 toward the fixed iron core 54 against the force of the spring 56 as shown in FIG. 3. Then, the second valve body 74 contacts the end of the valve member 68 that faces the drive force transmitting member 57 to close the communication passage 73. When the drive force transmitting member 57 presses the valve member 68, the valve opening degree of the first valve body 68*v* is reduced, so that the valve hole 65*h* is closed. This stops discharge of refrigerant gas from the control pressure chamber 35 to the suction chamber 15*a* via the second in-shaft passage 21*b*, the first in-shaft passage 21*a*, the pressure adjusting chamber 15*c*, the passage 71, the accommodating chamber 59, the valve hole 65*h*, the valve chamber 67, and the passage 72. Since refrigerant gas is introduced into the control pressure chamber 35 from the discharge chamber 15*b* via the restriction 36*a*, the communication portion 36*b*, the pressure adjusting chamber 15*c*, the first in-shaft passage 21*a*, and the second in-shaft passage 21*b*, the pressure in the control pressure chamber 35 approaches the pressure in the discharge chamber 15*b*.

Figure 4:
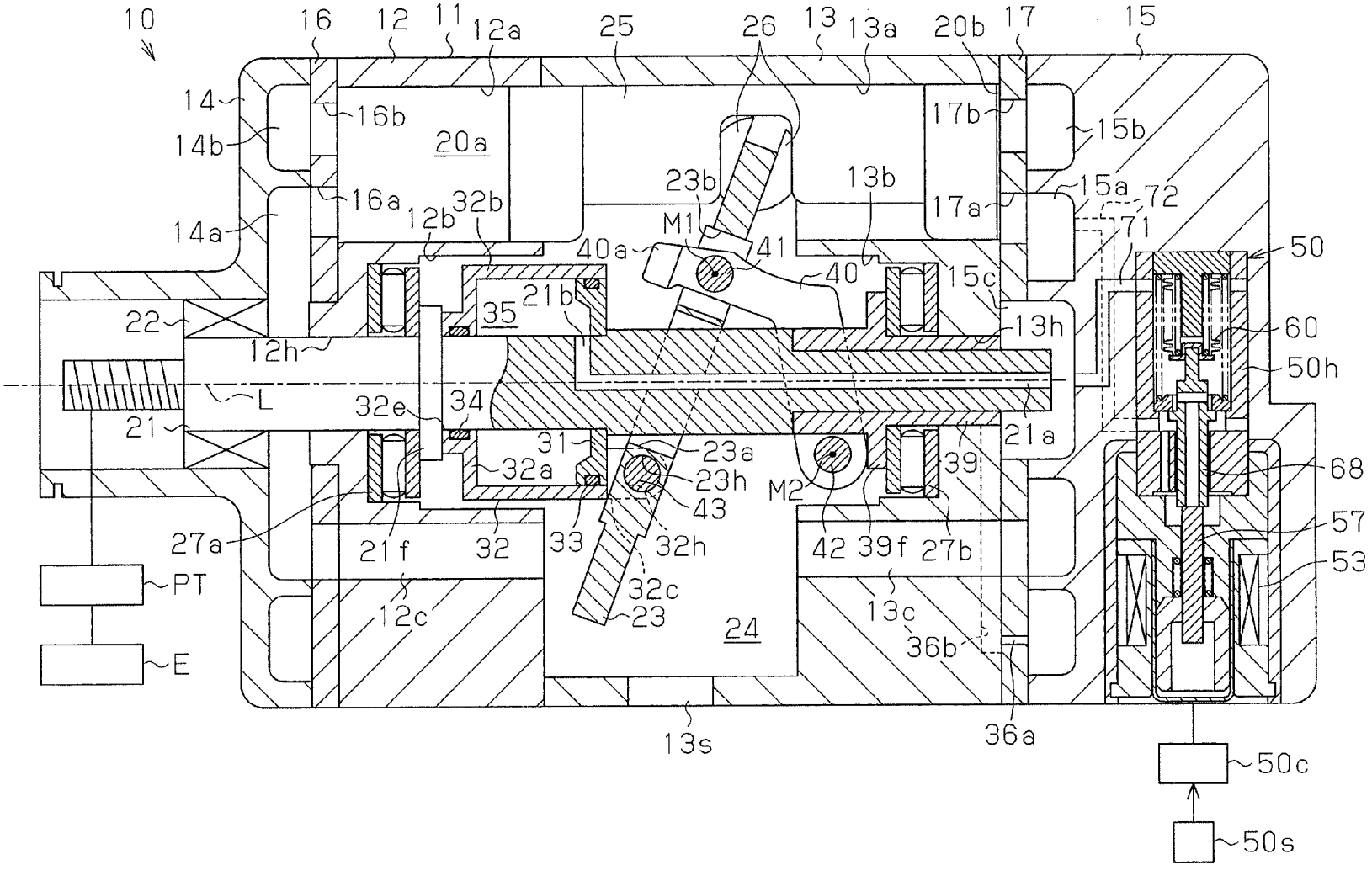
FIG. 4 is a cross-sectional side view illustrating the variable displacement swash plate type compressor when the swash plate is at the maximum inclination angle.

When the pressure difference between the control pressure chamber 35 and the crank chamber 24 is increased, the movable body 32 is moved such that the bottom portion 32*a* of the movable body 32 is separated away from the fixed body 31 as shown in FIG. 4. This causes the swash plate 23 to pivot about the first pivot axis M1. As the swash plate 23 pivots about the first pivot axis M1, the ends of the lug arm 40 pivot about the first pivot axis M1 and the second pivot axis M2, respectively, so that the lug arm 40 is separated away from the flange portion 39*f* of the supporting member 39. This increases the inclination angle of the swash plate 23 and thus increases the stroke of the double-headed pistons 25. Accordingly, the displacement is increased. The movable body 32 is configured to contact the flange portion 21*f* when the swash plate 23 reaches the maximum inclination angle. The contact between the movable body 32 and the flange portion 21*f* maintains the maximum inclination angle of the swash plate 23.

An increase in the valve opening degree of the first valve body 68*v* as shown in FIG. 2 increases the flow rate of refrigerant gas that is discharged from the control pressure chamber 35 to the suction chamber 15*a* via the second in-shaft passage 21*b*, the first in-shaft passage 21*a*, the pressure adjusting chamber 15*c*, the passage 71, the accommodating chamber 59, the valve hole 65*h*, the valve chamber 67, and the passage 72, so that the pressure in the control pressure chamber 35 approaches the pressure in the suction chamber 15*a*.

When the pressure difference between the control pressure chamber 35 and the crank chamber 24 is decreased, the movable body 32 is moved such that the bottom portion 32*a* of the movable body 32 approaches the fixed body 31 as shown in FIG. 1. This causes the swash plate 23 to pivot about the first pivot axis M1 in a direction opposite to the pivoting direction for increasing the inclination angle of the swash plate 23. As the swash plate 23 pivots about the first pivot axis M1 in a direction opposite to the inclination angle increasing direction, the ends of the lug arm 40 pivot about the first pivot axis M1 and the second pivot axis M2, respectively, in a direction opposite to the pivoting direction for increasing the inclination angle of the swash plate 23, so that the lug arm 40 approaches the flange portion 39*f* of the supporting member 39. This reduces the inclination angle of the swash plate 23 and thus reduces the stroke of the double-headed pistons 25. Accordingly, the displacement is decreased. The lug arm 40 is configured to contact the flange portion 39*f* of the supporting member 39 when the swash plate 23 reaches the minimum inclination angle. The contact between the lug arm 40 and the flange portion 39*f* maintains the minimum inclination angle of the swash plate 23.

Operation of the present embodiment will now be described.

In a state in which the first valve body 68*v* and the second valve body 74 are closed, if the air conditioner switch 50*s* is turned off and the current supply to the electromagnetic solenoid 53 is stopped, the movable iron core 55 is separated from the fixed iron core 54 by the urging force of the spring 56. This moves the drive force transmitting member 57 in the moving direction of the movable iron core 55. At this time, if the pressure in the suction chamber 15*a* is less than a first predetermined value, which is a threshold value, the urging force of the spring 64 of the bellows 62 moves the valve member 68 in the moving direction of the movable iron core 55 together with the drive force transmitting member 57. As the valve member 68 is moved, the first valve body 68*v* opens. Since the valve member 68 is maintained to be in contact with the drive force transmitting member 57, the second valve body 74 is maintained to be closed.

Accordingly, the refrigerant gas is discharged from the control pressure chamber 35 to the suction chamber 15*a* via the second in-shaft passage 21*b*, the first in-shaft passage 21*a*, the pressure adjusting chamber 15*c*, the passage 71, the accommodating chamber 59, the valve hole 65*h*, the valve chamber 67, and the passage 72. This allows the pressure in the control pressure chamber 35 to be substantially equal to the pressure in the suction chamber 15*a* when the current supply to the electromagnetic solenoid 53 is stopped. Therefore, the inclination angle of the swash plate 23 is minimized.

Figure 5:
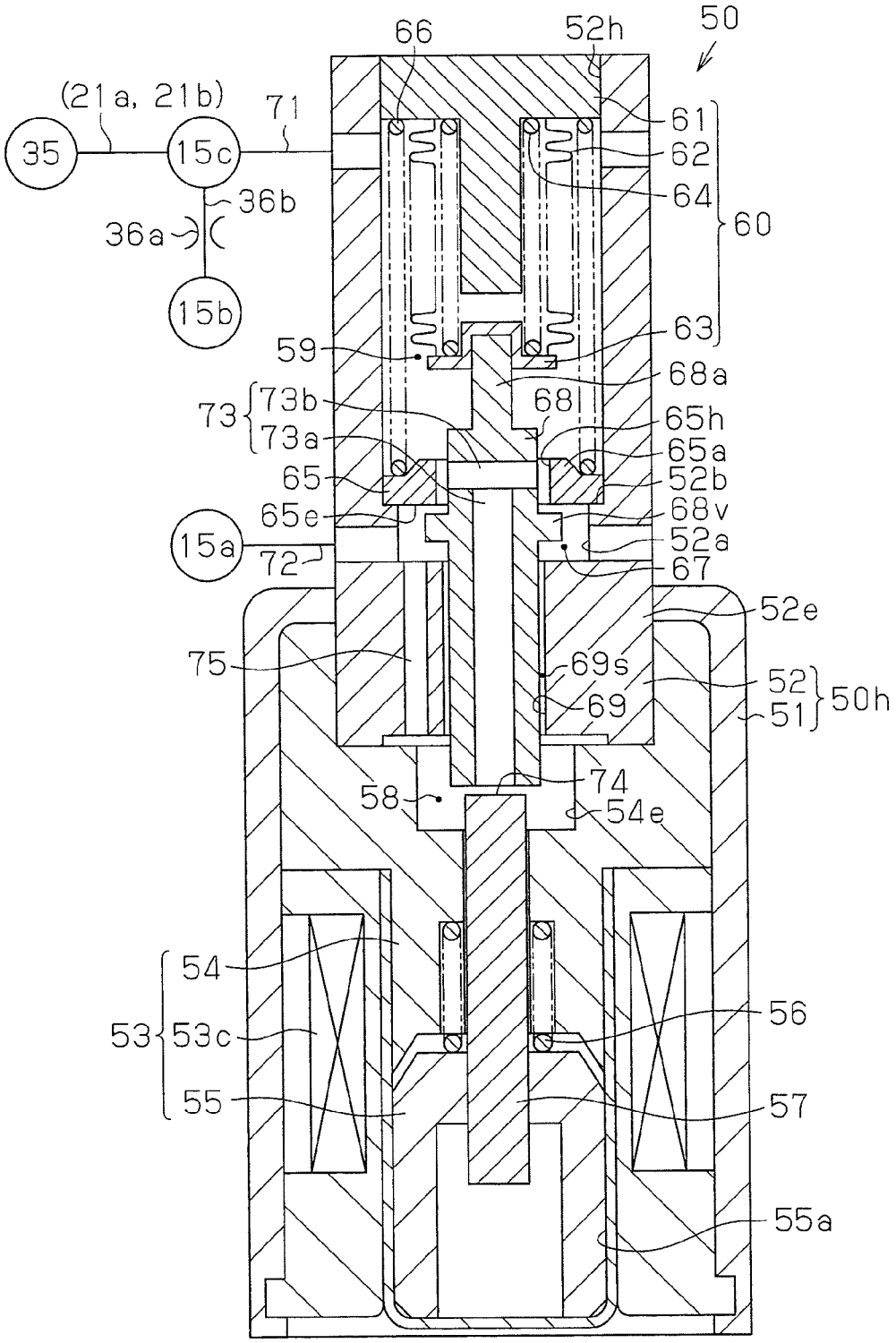
FIG. 5 is a cross-sectional view of the displacement control valve when the pressure in the suction chamber is greater than or equal to a first predetermined value and less than a second predetermined value, which is greater than the first predetermined value.

When the pressure in the suction chamber 15*a* is greater than or equal to the first predetermined value and less than a second predetermined value, which is greater than the first predetermined value, the valve member 68 is moved toward the movable iron core 55 by the urging force of the spring 64 of the bellows 62 as shown in FIG. 5. At this time, the valve member 68 is separated from the drive force transmitting member 57 while maintaining the open state of first valve body 68*v*, so that the second valve body 74 opens. As the pressure in the suction chamber 15*a* approaches the second predetermined value, the opening degree of the first valve body 68*v* is decreased and the opening degree of the second valve body 74 is increased.

Accordingly, the refrigerant gas is discharged from the control pressure chamber 35 to the suction chamber 15*a* via the second in-shaft passage 21*b*, the first in-shaft passage 21*a*, the pressure adjusting chamber 15*c*, the passage 71, the accommodating chamber 59, the valve hole 65*h*, the communication passage 73, the back pressure chamber 58, the communication passage 75, the clearance 69*s*, the valve chamber 67, and the passage 72. This allows the pressure in the control pressure chamber 35 to be substantially equal to the pressure in the suction chamber 15*a* when the current supply to the electromagnetic solenoid 53 is stopped. Therefore, the inclination angle of the swash plate 23 is minimized.

Figure 6:
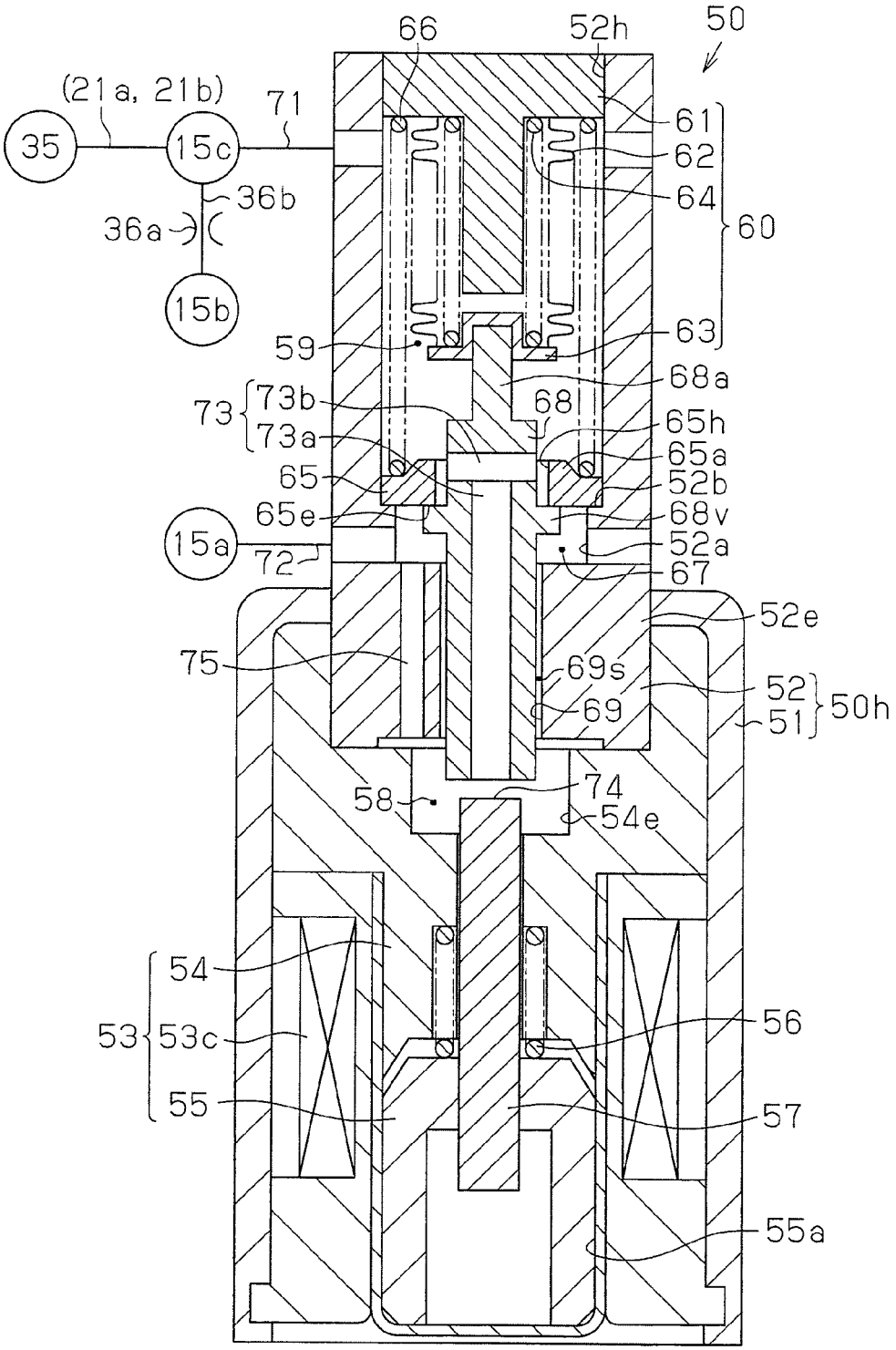
FIG. 6 is a cross-sectional view of the displacement control valve when the pressure in the suction chamber is greater than or equal to the second predetermined value.

When the pressure in the suction chamber 15*a* is greater than or equal to the second predetermined value, the pressure in the suction chamber 15*a* urges the valve member 68 toward the bellows 62 as shown in FIG. 6. This causes the first valve body 68*v* to close, and the valve member 68 is separated from the drive force transmitting member 57, so that the second valve body 74 opens.

Accordingly, the refrigerant gas is discharged from the control pressure chamber 35 to the suction chamber 15*a* via the second in-shaft passage 21*b*, the first in-shaft passage 21*a*, the pressure adjusting chamber 15*c*, the passage 71, the accommodating chamber 59, the communication passage 73, the back pressure chamber 58, the communication passage 75, the clearance 69*s*, the valve chamber 67, and the passage 72. This allows the pressure in the control pressure chamber 35 to be substantially equal to the pressure in the suction chamber 15*a* when the current supply to the electromagnetic solenoid 53 is stopped. Therefore, the inclination angle of the swash plate 23 is minimized.

Thereafter, when the air conditioner switch 50*s* is turned on and a current supply to the electromagnetic solenoid 53 is resumed, the variable displacement swash plate type compressor 10 is operated at the minimum displacement. Thus, the load on the variable displacement swash plate type compressor 10 is prevented from being increased due to an abrupt increase in the displacement.

When the air conditioner switch 50*s* is turned on and current is supplied to the electromagnetic solenoid 53, the first valve body 68*v* and the second valve body 74 close. This prevents the refrigerant gas from being discharged from the control pressure chamber 35 to the valve chamber 67 and the back pressure chamber 58 via the second in-shaft passage 21*b*, the first in-shaft passage 21*a*, the pressure adjusting chamber 15*c*, the passage 71, the accommodating chamber 59, the valve hole 65*h*, and the communication passage 73. As a result, the pressure in the valve chamber 67 and the back pressure chamber 58 is prevented from being equalized with the pressure in the control pressure chamber 35.

In a case in which the rotary shaft 21 receives rotational drive force from the engine E via the power transmission mechanism PT, which is a clutchless mechanism, the rotational drive force is constantly transmitted to the rotary shaft 21 from the engine E via the power transmission mechanism PT even if no current is supplied to the electromagnetic solenoid 53. Therefore, the power of the engine E is consumed slightly. Therefore, to minimize consumption of the power of the engine E, minimum displacement operation, in which the swash plate 23 is maintained at the minimum inclination angle, is preferable in a state in which no current is supplied to the electromagnetic solenoid 53.

Therefore, when no current is supplied to the electromagnetic solenoid 53, the opening degree of the first valve body 68*v* is maximized so that refrigerant gas is discharged from the control pressure chamber 35 to the suction chamber 15*a* via the discharge passage. Accordingly, the displacement control valve 50 substantially equalizes the pressure in the control pressure chamber 35 with the pressure in the suction chamber 15*a* and minimizes the inclination angle of the swash plate 23. However, if the pressure in the suction chamber 15*a* exceeds the second predetermined pressure when no current is supplied to the electromagnetic solenoid 53, the pressure in the valve chamber 67 and the back pressure chamber 58 is also increased. Therefore, in some cases, the pressure in the valve chamber 67 and the back pressure chamber 58 causes the first valve body 68*v* to close the discharge passage, which is undesirable.

Therefore, in the present embodiment, if the pressure in the suction chamber 15*a* exceeds the first predetermined value when no current is supplied to the electromagnetic solenoid 53, the second valve body 74 opens. Accordingly, the refrigerant gas is discharged from the control pressure chamber 35 to the suction chamber 15*a* via the second in-shaft passage 21*b*, the first in-shaft passage 21*a*, the pressure adjusting chamber 15*c*, the passage 71, the accommodating chamber 59, the communication passage 73, the back pressure chamber 58, the communication passage 75, the clearance 69*s*, the valve chamber 67, and the passage 72. As a result, even if the pressure in the suction chamber 15*a* exceeds the first predetermined value when the current supply to the electromagnetic solenoid 53 is stopped, the inclination angle of the swash plate 23 is minimized since the pressure in the control pressure chamber 35 is substantially equalized with the pressure in the suction chamber 15*a*. Thus, in a state in which no current is supplied to the electromagnetic solenoid 53 in a configuration in which the rotary shaft 21 receives rotational drive force from the engine E via the power transmission mechanism PT, which is a clutchless mechanism, the inclination angle of the swash plate 23 is changed to and maintained at the minimum inclination even if the pressure in the suction chamber 15*a* changes. This ensures the minimum displacement operation. As a result, the power consumption of the engine E is minimized.

Figure 7:
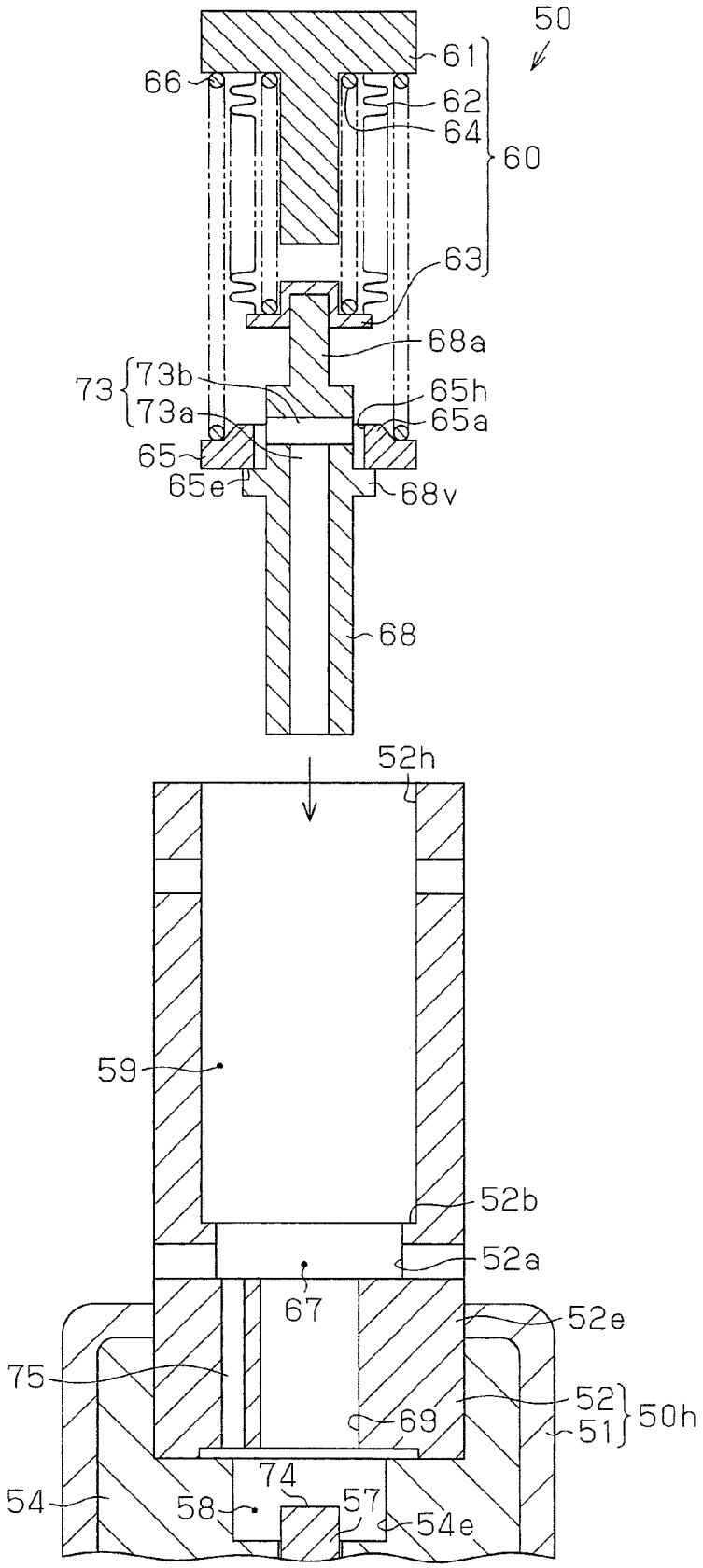
FIG. 7 is a partial cross-sectional view illustrating a state before the pressure sensing mechanism, the valve seat member, and the valve member are installed in the valve housing.

As shown in FIG. 7, the urging spring 66 is located between the valve seat member 65 and the pressure receiving body 61. That is, the urging spring 66 urges the valve seat member 65 toward the first valve body 68*v*. In this configuration, before the pressure sensing mechanism 60, the valve seat member 65, and the valve member 68 are installed in the valve housing 50*h*, the urging spring 66 urges the valve seat member 65 toward the first valve body 68*v*. Therefore, the pressure sensing mechanism 60, the valve seat member 65, and the valve member 68 are assembled as a unit via the urging spring 66. Compared to a case in which the pressure sensing mechanism 60, the valve seat member 65, and the valve member 68 are independent, the unit can be easily installed in the valve housing 50*h*. Since the urging spring 66 is located between the valve seat member 65 and the pressure sensing mechanism 60, the positions of the valve seat member 65 and the pressure sensing mechanism 60 can be adjusted by using the urging spring 66 during installation. This allows the positions of the valve seat member 65 and the pressure sensing mechanism 60 to be easily determined.

The above described embodiment provides the following advantages.

(1) The valve member 68 has the communication passage 73, which connects the back pressure chamber 58 and the accommodating chamber 59 with each other, and the drive force transmitting member 57 has the second valve body 74, which selectively opens and closes the communication passage 73. The second valve body 74 closes when current is supplied to the electromagnetic solenoid 53 and opens when the current supply to the electromagnetic solenoid 53 is stopped and the pressure in the suction chamber 15*a* is greater than or equal to the first predetermined value. Accordingly, since the communication passage 73 is opened by the second valve body 74 when the current supply to the electromagnetic solenoid 53 is stopped, the refrigerant gas is discharged from the control pressure chamber 35 to the suction chamber 15*a* via the accommodating chamber 59, the communication passage 73, the back pressure chamber 58, and the valve chamber 67. This allows the pressure in the control pressure chamber 35 to be substantially equal to the pressure in the suction chamber 15*a* when the current supply to the electromagnetic solenoid 53 is stopped. Therefore, even if the pressure in the suction chamber 15*a* changes, the inclination angle of the swash plate 23 can be changed to and maintained at the minimum inclination angle. When current is supplied to the electromagnetic solenoid 53, the communication passage 73 is closed by the second valve body 74. Accordingly, the refrigerant gas in the control pressure chamber 35 is prevented from flowing to the back pressure chamber 58 via the accommodating chamber 59 and the communication passage 73, so that the pressure in the back pressure chamber 58 is prevented from being equalized with the pressure in the control pressure chamber 35.

(2) The displacement control valve 50 has the guide wall 69, which guides the valve member 68 in the moving direction of the drive force transmitting member 57. The valve chamber 67 and the back pressure chamber 58 are connected to each other via the clearance 69*s* between the guide wall 69 and the valve member 68. Since the valve member 68 is guided by the guide wall 69, the valve member 68 is prevented from being tilted with respect to the moving direction, so that the first valve body 68*v* is guided to a reliable closed state. Since the clearance 69*s* is formed between the guide wall 69 and the valve member 68, the valve member 68 moves smoothly. This allows the first valve body 68*v* to move smoothly. The responsiveness of the displacement control valve 50 is improved accordingly.

(3) The valve chamber 67 and the back pressure chamber 58 are connected to each other by the communication passage 75. This configuration expedites the discharge of refrigerant gas from the control pressure chamber 35 to the suction chamber 15*a* when the current supply to the electromagnetic solenoid 53 is stopped, compared to a case in which, for example, the valve chamber 67 and the back pressure chamber 58 are connected to each other only by the clearance 69*s* between the guide wall 69 and the valve member 68 without providing the communication passage 75. When current is supplied to the electromagnetic solenoid 53, the pressure in the back pressure chamber 58 is equalized with the pressure in the suction chamber 15*a*, which is equal to that in the valve chamber 67, since the back pressure chamber 58 is connected to the valve chamber 67 via the communication passage 75. This configuration shortens the time for the pressure in the back pressure chamber 58 to be equalized with the pressure in the suction chamber 15*a*, which is equal to the valve chamber 67, compared to a case in which, for example, the valve chamber 67 and the back pressure chamber 58 are connected to each other only by the clearance 69*s* between the guide wall 69 and the valve member 68 without providing the communication passage 75.

(4) For example, if a valve seat on which the first valve body 68*v* is seated is formed integrally with the valve housing 50*h*, the valve seat can hinder the installation of the valve member 68 in the valve housing 50*h* when the valve member 68 is installed in the valve housing 50*h*. Therefore, the valve seat 65*e*, on which the first valve body 68*v* is seated, is formed on the valve seat member 65, and the valve seat member 65 is formed separately from the valve housing 50*h*. This allows the valve seat member 65 to be moved relative to the valve housing 50*h* at the installation of the valve member 68 in the valve housing 50*h*. Therefore, the valve seat 65*e* does not hinder the installation of the valve member 68 in the valve housing 50*h*. Accordingly, the procedure for installing the valve member 68 in the valve housing 50*h* is simplified.

(5) The urging spring 66 for urging the valve seat member 65 toward the first valve body 68*v* is located between the valve seat member 65 and the pressure sensing mechanism 60. In this configuration, before the pressure sensing mechanism 60, the valve seat member 65, and the valve member 68 are installed in the valve housing 50*h*, the urging spring 66 urges the valve seat member 65 toward the first valve body 68*v*. Therefore, the pressure sensing mechanism 60, the valve seat member 65, and the valve member 68 are assembled as a unit via the urging spring 66. Compared to a case in which the pressure sensing mechanism 60, the valve seat member 65, and the valve member 68 are independent, the unit can be easily installed in the valve housing 50*h*. Since the urging spring 66 is located between the valve seat member 65 and the pressure sensing mechanism 60, the positions of the valve seat member 65 and the pressure sensing mechanism 60 can be adjusted by using the urging spring 66 during installation. This allows the positions of the valve seat member 65 and the pressure sensing mechanism 60 to be easily determined.

(6) According to the present embodiment, the inclination angle of the swash plate 23 can be minimized when the current supply to the electromagnetic solenoid 53 is stopped. Therefore, when the current supply to the electromagnetic solenoid 53 is resumed, the variable displacement swash plate type compressor 10 is operated at the minimum displacement. Thus, the load on the variable displacement swash plate type compressor 10 is prevented from being increased due to an abrupt increase in the displacement.

(7) The variable displacement swash plate type compressor 10 of the present embodiment receives rotational drive force from the engine E via the power transmission mechanism PT, which is a clutchless mechanism. This configuration reduces the weight of the entire variable displacement swash plate type compressor 10 and the electricity consumption for driving the power transmission mechanism, which is an electromagnetic clutch mechanism, compared to a case in which the rotary shaft 21 receives rotational drive force from the engine E via a power transmission mechanism that is an electromagnetic clutch mechanism only when current is supplied to the electromagnetic solenoid 53.

(8) According to the present embodiment, in a state in which no current is supplied to the electromagnetic solenoid 53 in a configuration in which the rotary shaft 21 receives rotational drive force from the engine E via the power transmission mechanism PT, which is a clutchless mechanism, the inclination angle of the swash plate 23 can be changed to the minimum inclination even if the pressure in the suction chamber 15*a* increases. This ensures the minimum displacement operation. As a result, the power consumption of the engine E is minimized.

(9) The fixed iron core 54 has a recess 54*e*, which is formed in an end face of the fixed iron core 54 that faces the bottom wall 52*e* of the second housing member 52 and surrounds the drive force transmitting member 57. The recess 54*e* and the bottom wall 52*e* define the back pressure chamber 58. This configuration extends the guide wall 69 in the moving direction of the drive force transmitting member 57 compared to a case in which the back pressure chamber 58 is defined by the fixed iron core 54 and a recess that is formed in the bottom wall 52*e* of the second housing member 52 that faces the fixed iron core 54 and surrounds the drive force transmitting member 57. As a result, it is easy to reduce the possibility that the valve member 68 may be inclined with respect to the moving direction of the drive force transmitting member 57. Also, the drive force transmitting member 57 can be shortened in the moving direction, so that the weight of the drive force transmitting member 57 is reduced. This allows the force of the spring 56 to be minimized and the size of the coil 53*c* to be reduced.

(10) The valve member 68 is formed of a material that is lighter than that of the drive force transmitting member 57 (for example, of aluminum). Therefore, the increase in the weight of the displacement control valve 50 will be limited even if the size of the first valve body 68*v* is increased.

(11) The surface of the valve member 68 is subjected to surface treatment, for example, coating of a high abrasion resistance. This minimizes the sliding resistance between the guide wall 69 and the valve member 68, which is generated when the valve member 68 is guided in the moving direction of the drive force transmitting member 57 by the guide wall 69.

The above described embodiment may be modified as follows.

Figure 8:
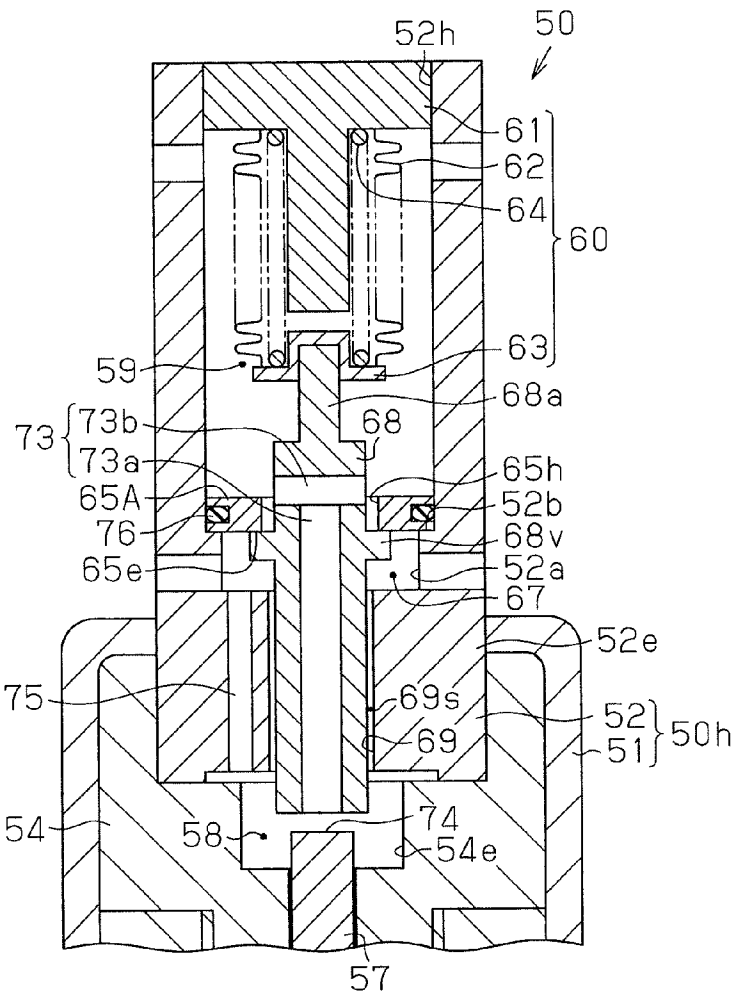
FIG. 8 is a partial cross-sectional view showing a displacement control valve according to another embodiment.

As shown in FIG. 8, a sealing member 76 may be provided between a valve seat member 65A and the valve housing 50*h*. The sealing member 76 is annular and attached to the outer circumference of the valve seat member 65A. The sealing member 76 seals the boundary between the valve seat member 65A and the valve housing 50*h* even if the valve seat member 65A is moved toward the pressure sensing mechanism 60 by the first valve body 68*v* pressing the valve seat 65*e* when the first valve body 68*v* is seated on the valve seat 65*e* to maximize the inclination angle of the swash plate 23. This prevents the refrigerant gas in the control pressure chamber 35 from leaking to the suction chamber 15*a* via the clearance between the valve seat member 65A and the valve housing 50*h*, and thus allows the pressure in the control pressure chamber 35 to be accurately controlled to maximize the inclination angle of the swash plate 23.

As shown in FIG. 8, the urging spring 66 may be omitted. In this case, at the assembly of the valve housing 50*h*, refrigerant gas is introduced from the control pressure chamber 35 to the accommodating chamber 59 with the pressure sensing mechanism 60, the valve seat member 65, and the valve member 68 arranged in the valve housing 50*h*, so that the valve seat member 65 is pressed against the step 52*b* by the pressure of the refrigerant gas introduced into the accommodating chamber 59. The valve seat member 65A is positioned by pressing the valve seat member 65A against the step 52*b* by the pressure of the refrigerant gas.

Figure 9:
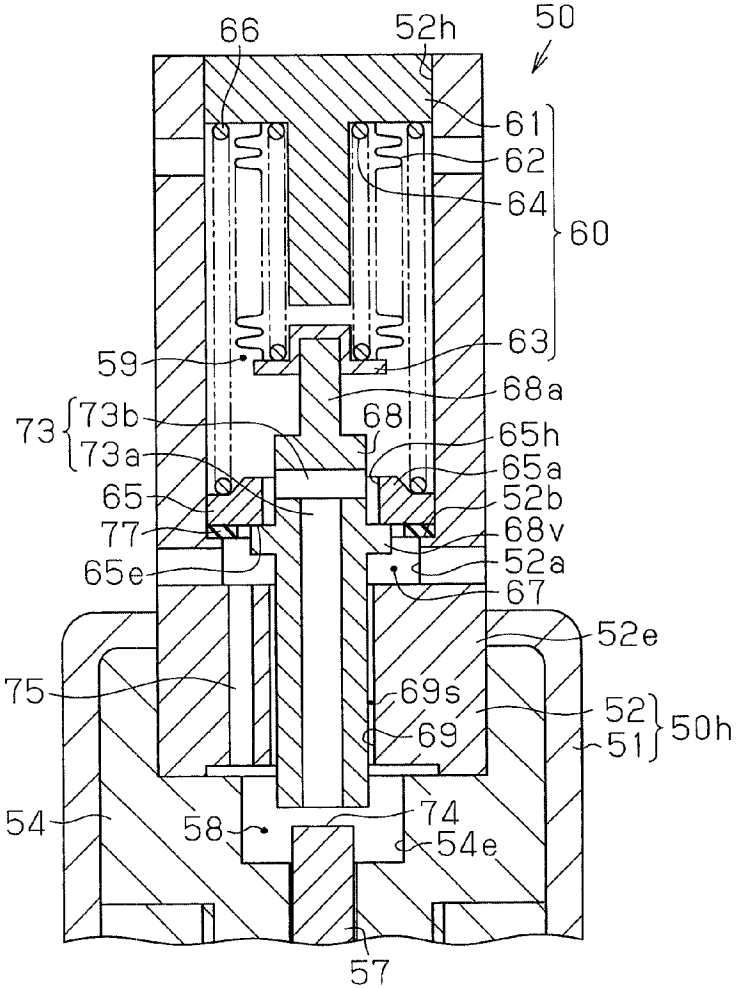
FIG. 9 is a partial cross-sectional view showing a displacement control valve according to a further embodiment.

As shown in FIG. 9, a cushioning member 77 may be located between the valve seat member 65 and the valve housing 50*h* in the moving direction of the drive force transmitting member 57. The cushioning member 77 is an annular rubber member. When the first valve body 68*v* is seated onto the valve seat 65*e*, the cushioning member 77 prevents the vibration that is transmitted from the first valve body 68*v* to the valve seat member 65 from being further transmitted to the valve housing 50*h*, which suppresses generation of noise due to the vibration.

Figure 10:
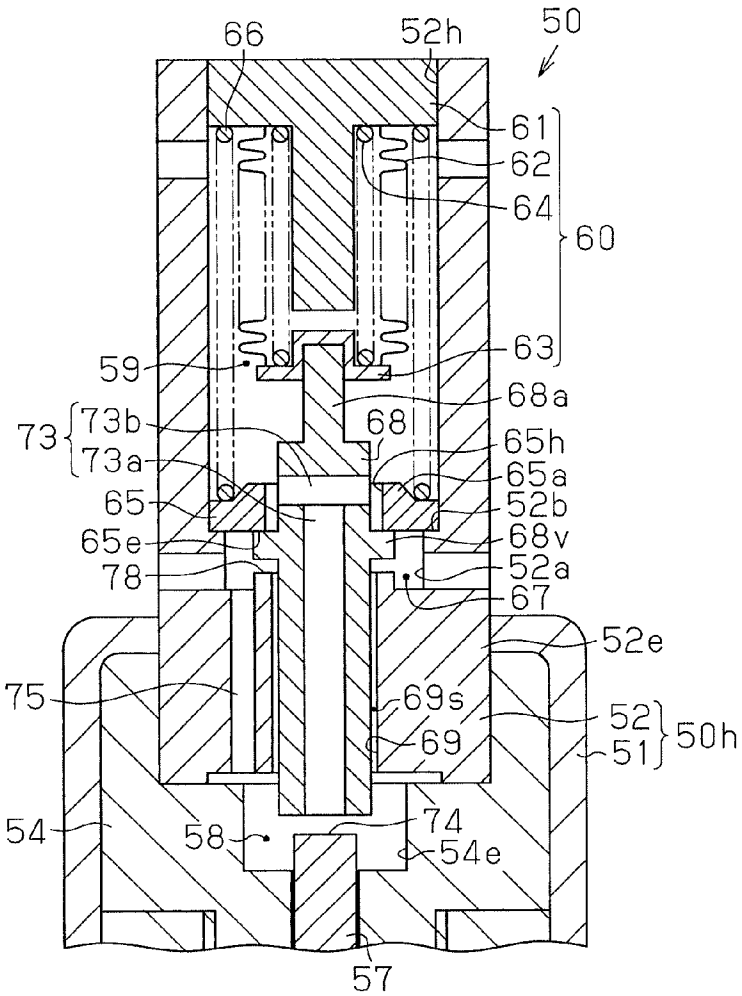
FIG. 10 is a partial cross-sectional view showing a displacement control valve according to another embodiment.

As shown in FIG. 10, the valve housing 50*h* may include a stopper portion 78, which is located in the valve chamber 67 and protrudes toward an end face of the first valve body 68*v* that is opposite to the valve seat 65*e*. In this case, the stroke of the first valve body 68*v* is shorter than the stroke of the drive force transmitting member 57. Thus, vibration of the first valve body 68*v* can be easily suppressed.

Figure 11:
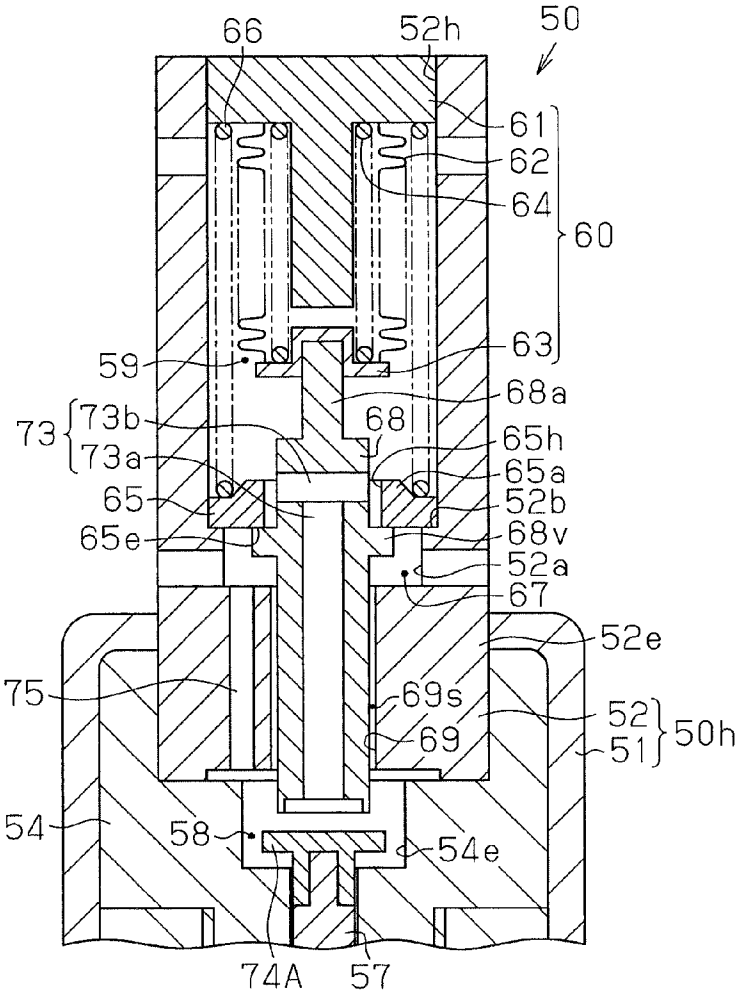
FIG. 11 is a partial cross-sectional view showing a displacement control valve according to a further embodiment.

As shown in FIG. 11, a second valve body 74A may be provided that is formed separately from the drive force transmitting member 57. The outer diameter of the second valve body 74A is greater than the diameter of the shaft of the drive force transmitting member 57. The second valve body 74A is coupled to the drive force transmitting member 57 by press fitting an end of the drive force transmitting member 57 that faces the second valve body 74A into the second valve body 74A. In this configuration, since the outer diameter of the second valve body 74A can be made greater than the diameter of the shaft of the drive force transmitting member 57, the inner diameter of the communication passage 73 can be made greater than the diameter of the shaft of the drive force transmitting member 57. As a result, the refrigerant gas in the control pressure chamber 35 can be smoothly discharged to the back pressure chamber 58 via the communication passage 73.

Figure 12:
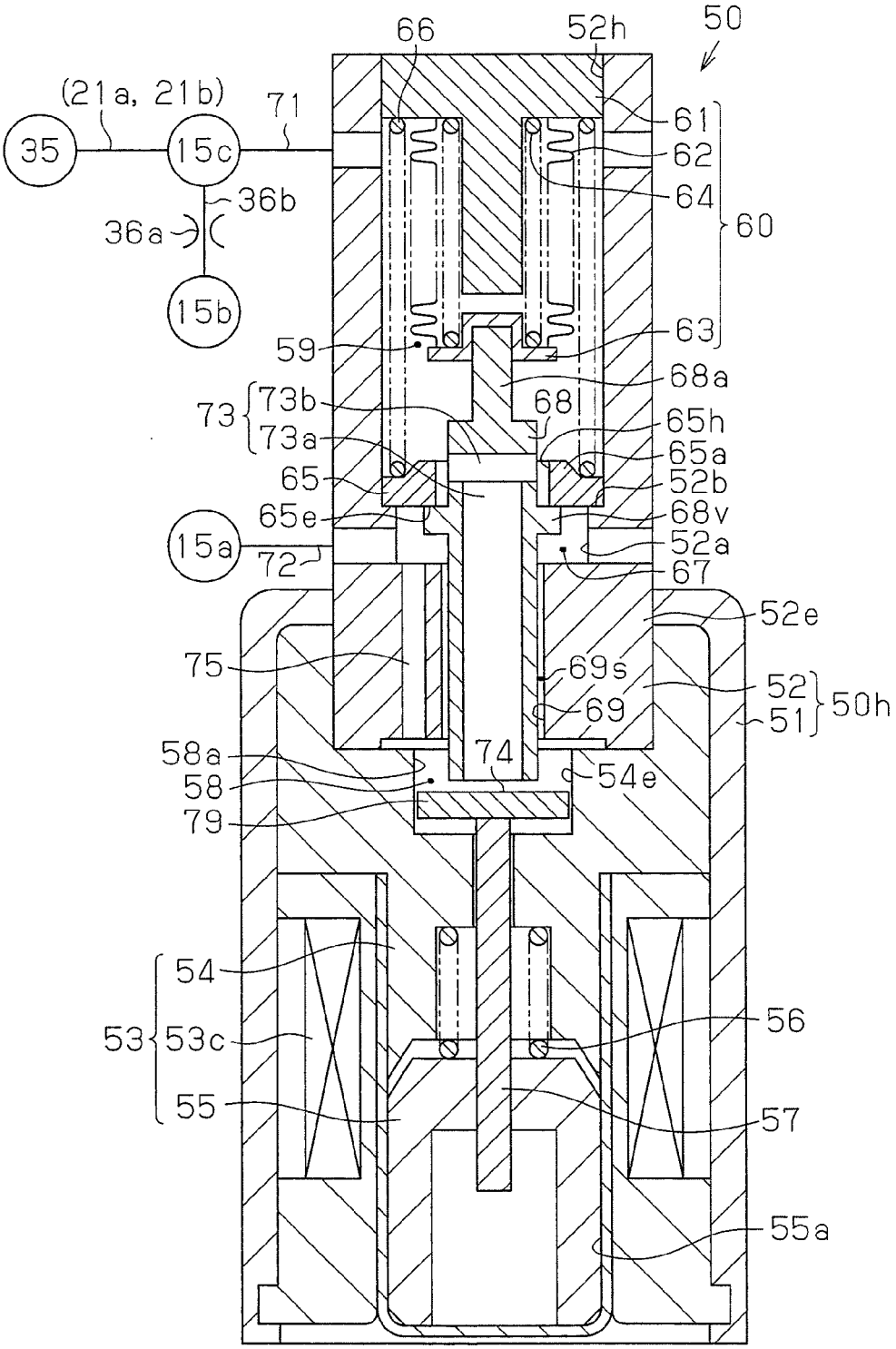
FIG. 12 is a cross-sectional view showing a displacement control valve according to another embodiment.

As shown in FIG. 12, a movable member 79 may be provided between the drive force transmitting member 57 and the valve member 68. The movable member 79 has a second valve body 74 and is movable in the back pressure chamber 58 in the moving direction of the drive force transmitting member 57. The movable member 79 has a greater cross-sectional area than that of the drive force transmitting member 57. The movable member 79 is guided by an inner circumferential surface 58*a* of the back pressure chamber 58. A zone in the back pressure chamber 58 that is on the side of the movable member 79 that is closer to the valve member 68 and a zone that is closer to the drive force transmitting member 57 are connected to each other via the clearance between the movable member 79 and the inner circumferential surface 58*a* of the back pressure chamber 58. Therefore, the refrigerant gas in the zone of the back pressure chamber 58 that is closer to the valve member 68 can flow into the zone of the back pressure chamber 58 that is closer to the drive force transmitting member 57 via the clearance between the movable member 79 and the inner circumferential surface 58*a* of the back pressure chamber 58.

In this configuration, since the outer diameter of the second valve body 74A can be made greater than the diameter of the shaft of the drive force transmitting member 57, the inner diameter of the communication passage 73 (the first passage 73*a*) can be made greater than the diameter of the shaft of the drive force transmitting member 57. This allows the diameter of the shaft of the drive force transmitting member 57 to be reduced, so that the weight of the drive force transmitting member 57 is reduced. Accordingly, the size of the electromagnetic solenoid 53 (coil c) can be reduced. Since the second valve body 74 can be formed simply by providing the movable member 79, which conforms to the shape of the inner circumferential surface 58*a* of the back pressure chamber 58, the structure of the displacement control valve 50 is simplified.

In the illustrated embodiment, for example, the back pressure chamber 58 may be defined by the fixed iron core 54 and a recess that is formed in the bottom wall 52*e* of the second housing member 52 that faces the fixed iron core 54 and surrounds the drive force transmitting member 57.

In the illustrated embodiment, the valve member 68 may be formed of any material that is lighter than that of the drive force transmitting member 57. For example, the valve member 68 may be formed of plastic.

In the illustrated embodiment, the surface of the valve member 68 does not necessarily need to be subjected to surface treatment, for example, coating of a high abrasion resistance.

In the illustrated embodiment, a valve seat on which the first valve body 68*v* is seated may be formed integrally with the valve housing 50*h*.

In the illustrated embodiment, the communication passage 75 may be omitted. In this case, it is preferable to minimize the cross-sectional area of the clearance 69*s* between the guide wall 69 and the valve member 68.

In the illustrated embodiment, the valve chamber 67 may be connected to the suction chamber 14*a* via the passage 72 as long as a discharge passage is formed from the control pressure chamber 35 to the suction pressure zone.

In the illustrated embodiment, the discharge chamber 14*b* and the control pressure chamber 35 may be connected to each other via the restriction 36*a*, the communication portion 36*b*, the pressure adjusting chamber 15*c*, the first in-shaft passage 21*a*, and the second in-shaft passage 21*b*.

In the illustrated embodiment, the cross-sectional area of the valve hole 65*h* and the effective pressure receiving area of the bellows 62 do not necessarily need to be exactly the same as long as these areas are substantially equal to each other.

In the illustrated embodiment, the outer diameter of a part of the valve member 68 located in the valve chamber 67 may be reduced to form pressure receiving portion that receives the pressure in the valve chamber 67. The pressure sensing mechanism 60 may be configured to either extend or contract in the moving direction of the drive force transmitting member 57 in response to the pressure applied to the pressure receiving portion.

In the illustrated embodiment, drive power may be obtained from an external drive source via a clutch.

In the illustrated embodiment, the variable displacement swash plate type compressor 10 is a double-headed piston swash plate type compressor having the double-headed pistons 25, but may be a single-headed piston swash plate type compressor having single-headed pistons.

Therefore, the present examples and embodiments are to be considered as illustrative and not restrictive and the invention is not to be limited to the details given herein, but may be modified within the scope and equivalence of the appended claims.

The invention claimed is:

1. A variable displacement swash plate type compressor comprising:

a housing having a crank chamber;

a swash plate accommodated in the crank chamber, wherein the swash plate receives a drive force from a rotary shaft to rotate and is capable of changing its inclination angle relative to the rotary shaft;

a piston engaged with the swash plate;

a movable body, which is coupled to the swash plate and changes the inclination angle of the swash plate;

a control pressure chamber defined in the housing by the movable body, wherein pressure in the control pressure chamber is changed by introducing control gas therein so that the movable body is moved in the axial direction of the rotary shaft; and a displacement control valve that controls the pressure in the control pressure chamber, wherein the piston is reciprocated by a stroke that corresponds to the inclination angle of the swash plate, the displacement control valve includes:

a drive force transmitting member, which is driven by an electromagnetic solenoid;

a valve member having a first valve body, wherein the first valve body adjusts an opening degree of discharge passage that extends from the control pressure chamber to a suction pressure zone;

a valve chamber, which accommodates the first valve body and communicates with the suction pressure zone;

a back pressure chamber, which is located between the electromagnetic solenoid and the valve chamber and is connected to the valve chamber;

an accommodating chamber, which communicates with the control pressure chamber;

a pressure sensing mechanism, which is accommodated in the accommodating chamber and integrated with the valve member, wherein, by sensing, in at least one of the back pressure chamber and the valve chamber, a pressure in the suction pressure zone that acts on the valve member, the pressure sensing mechanism extends or contracts in the moving direction of the drive force transmitting member, thereby adjusting the valve opening degree of the first valve body;

a communication passage, which is formed in the valve member and connects the back pressure chamber and the accommodating chamber to each other; and a second valve body, which is located between the drive force transmitting member and the valve member and selectively opens and closes the communication passage, the first valve body is in an open state when a current supply to the electromagnetic solenoid is stopped and the pressure in the suction pressure zone is less than a threshold value, and the second valve body closes when a current is supplied to the electromagnetic solenoid and opens when the current supply to the electromagnetic solenoid is stopped and the pressure in the suction pressure zone is greater than or equal to the threshold value.

2. The variable displacement swash plate type compressor according to claim 1, further comprising a guide wall, which guides the valve member in the moving direction of the drive force transmitting member, wherein the valve chamber and the back pressure chamber are connected to each other via a clearance between the guide wall and the valve member.

3. The variable displacement swash plate type compressor according to claim 1, further comprising a communication passage, which connects the valve chamber and the back pressure chamber to each other.

4. The variable displacement swash plate type compressor according to claim 1, wherein the displacement control valve further includes:

a valve housing; and a valve seat member, which is formed separately from the valve housing, wherein the valve seat member has a valve seat, on which the first valve body is seated.

5. The variable displacement swash plate type compressor according to claim 4, further comprising an urging spring, which is provided between the valve seat member and the pressure sensing mechanism and urges the valve seat member toward the first valve body.

6. The variable displacement swash plate type compressor according to claim 4, further comprising a sealing member, which is provided between the valve seat member and the valve housing.

7. The variable displacement swash plate type compressor according to claim 4, further comprising a cushioning member, which is located between the valve seat member and the valve housing in the moving direction of the drive force transmitting member.

8. The variable displacement swash plate type compressor according to claim 1, further comprising a movable member, which is provided between the drive force transmitting member and the valve member, wherein the movable member includes the second valve body and is movable in the back pressure chamber in the moving direction of the drive force transmitting member, and the movable member has a greater cross-sectional area than that of the drive force transmitting member.

9. The variable displacement swash plate type compressor according to claim 8, wherein the movable member is guided by an inner circumferential surface of the back pressure chamber.

10. The variable displacement swash plate type compressor according to claim 1, wherein the piston is a double-headed piston.

11. The variable displacement swash plate type compressor according to claim 1, wherein the rotary shaft receives drive force from an external drive source via the power transmission mechanism, which is a clutchless mechanism.

* * * * *